US005497358A

United States Patent [19]

Koch

[11] Patent Number: 5,497,358

[45] Date of Patent: Mar. 5, 1996

[54] ANALOGUE DISPLAY TIMEPIECE EXHIBITING AT LEAST ONE UNIVERSAL TIME DISPLAY MODE

[75] Inventor: Daniel Koch, Crémines, Switzerland

[73] Assignee: ETA S.A. Fabriques d'Ebauches, Grenchen, Switzerland

[21] Appl. No.: 305,295

[22] Filed: Sep. 15, 1994

[30] Foreign Application Priority Data

Sep. 16, 1993 [CH] Switzerland ..... 02789/93

[51] Int. Cl.[6] ..... G04B 19/22

[52] U.S. Cl. ..... 368/21; 368/185

[58] Field of Search ..... 368/21, 28, 187

[56] References Cited

U.S. PATENT DOCUMENTS

| | | | |
|---|---|---|---|
| 693,814 | 2/1902 | Davis | 368/21 |
| 3,541,541 | 11/1970 | Engelbart | 340/324 |
| 3,823,548 | 7/1974 | Riba | 368/21 |
| 3,835,464 | 9/1974 | Rider | 340/324 A |
| 5,208,736 | 5/1993 | Crooks et al. | 361/393 |

FOREIGN PATENT DOCUMENTS

| | | |
|---|---|---|
| 2404250 | 4/1979 | France . |
| 2442433 | 6/1980 | France . |
| 4015685 | 11/1991 | Germany . |
| WO8808557 | 11/1988 | WIPO . |

OTHER PUBLICATIONS

Mills, Joshua "Among Desktop Users, Support Grows for the Trackball", New York Times, Jan. 9, 1994, p. 12.

Lampson, B. W. "Personal Distributed Computing: The Alto and Ethernet Software", from Goldberg, Adele, *A History of Personal Workstations* ACM Press, New York, 1988.

*Primary Examiner*—Bernard Roskoski

*Attorney, Agent, or Firm*—Sughrue, Mion, Zinn, Macpeak & Seas

[57] ABSTRACT

The invention concerns an analogue display timepeice exhibiting at least one universal time display mode. The timepice comprises:

time display means constituted in the form of an hour hand and a minute hand, time zone display means comprising at least one analogue indicating organ of said time zones and able to provide data relating to the geographical position of said time zones by reference to the earth, motor means able to drive said analogue display organs facing indications of respectively time and place, electronic control means arranged to drive said display means, this invention being characterized in that said analogue organ enabling the time zones to be indicated is comprised of at least one of the two time display hands, for example the hour hand, brought by electronic control means into a particular position in conjunction with the other hand, notably the minute hand.

8 Claims, 4 Drawing Sheets

ANALOGUE DISPLAY TIMEPIECE EXHIBITING AT LEAST ONE UNIVERSAL TIME DISPLAY MODE

The present invention concerns a timepiece exhibiting at least one universal time display mode, that is to say, providing the user with time information in relation to the 24 defined time zones around the world.

A timepiece of this type is known from document EP 0 364 602 which discloses a timepiece comprising, in addition to display hands respectively of the hour and minute, a third analogue organ also in the form of a hand and able to be pointed in the direction of one of the selected 24 time zones, in conjunction with a drawing representing the earth seen from the North Pole.

This structure is not the most rational as it necessitates the use of a third analogue organ, evidently with a specific corresponding arrangement of the guiding pipes in the horometric movement of this timepiece.

Thus a purpose of the present invention is to overcome this disadvantage by providing an analogue display timepiece exhibiting a universal time display mode, of the most simple construction possible, and whose display means do not cause any confusion in reading the dial, which contains numerous time and geographical data.

Therefore, the invention concerns an analogue display timepiece which is characterised in that the analogue organ enabling the time zones to be identified is made up of at least one of the two time display hands, for example the hour hand, brought by electronic control means into a distinctive position in combination with the other hand, notably the minute hand.

It should be noted here that the analogue organ enabling the time zones to be identified preferably consists of both the hour hand and the minute hand, brought by electronic control means into a superposed position, one in relation to the other.

Other characteristics and advantages of the invention will become clear upon reading the following detailed description, made with reference to the attached drawings, which are given purely by way of example, and in which:

FIG. 1 shows, in the form of a block diagram, a timepiece, for example a watch, with a universal time display mode, and consists of a first embodiment of the present invention.

Figure 1:
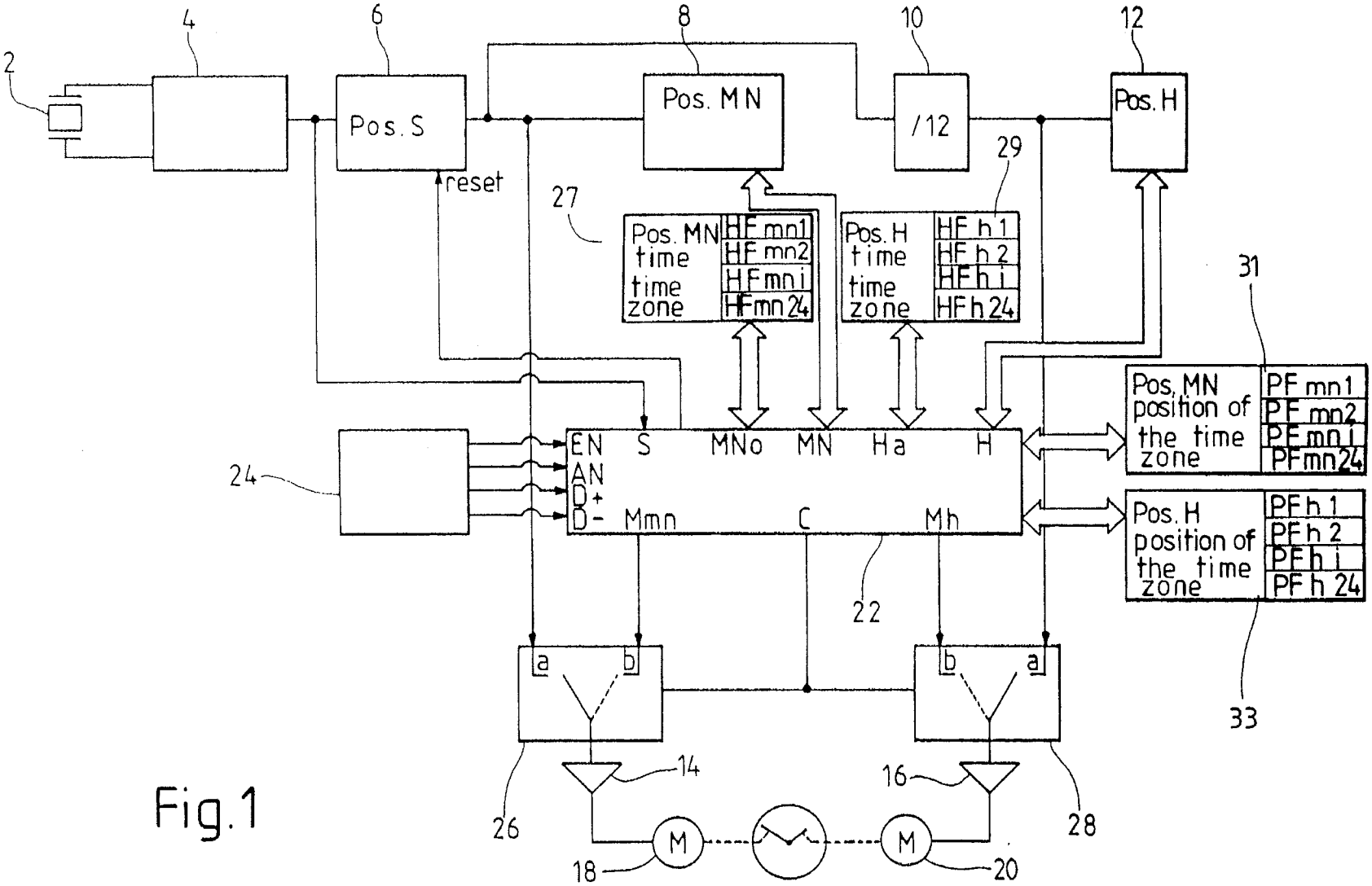
FIG. 1 shows in the form of a block diagram a universal time display watch, according to the present invention.

This timepiece includes, in series, a quartz oscillator 2, a division chain, issuing a signal of 1 Hz, a second hand position counter, referenced 6, and a minute hand position counter, referenced 8.

It also includes a divider-by-12, referenced 10, receiving the signal from the second hand position counter 6, and an hour hand position counter, referenced 12, whose input is connected to the output of divider 10. Counters 6, 8 and 12 are counters-by-sixty whose operation mode is shown in FIG. 2.

Figure 2:
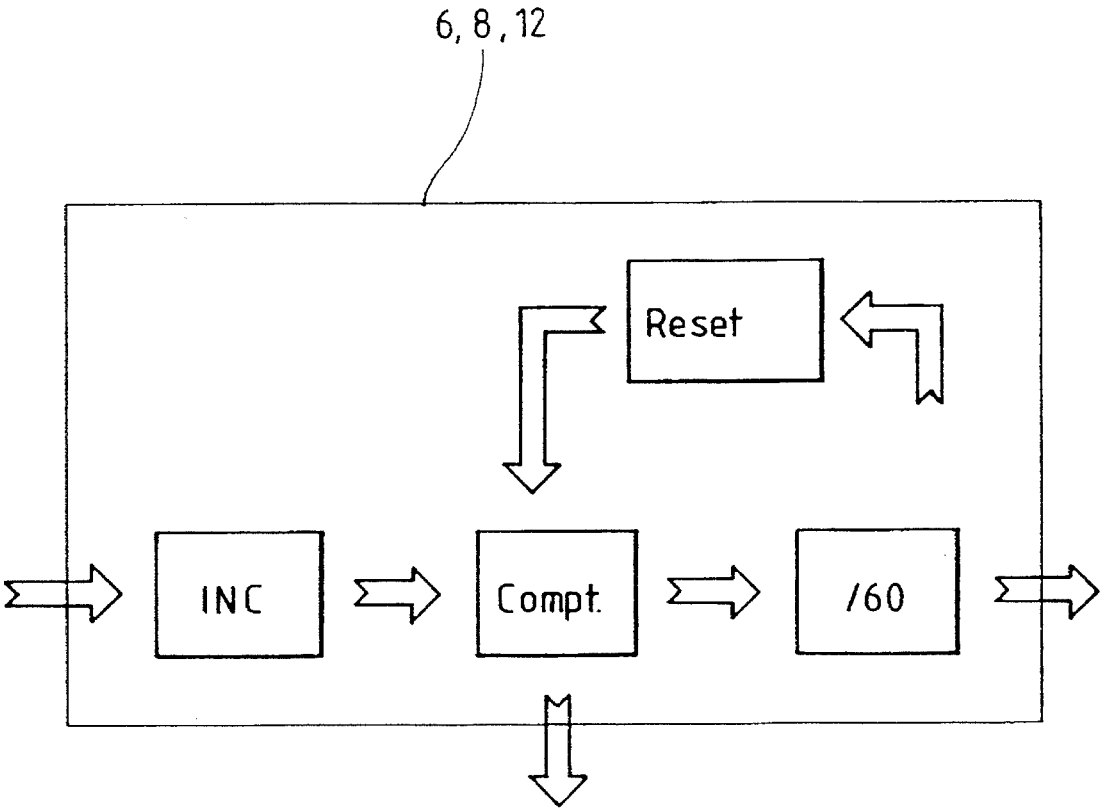
FIG. 2 is a operation diagram of a position counter, of the type of those incorporated in the diagram of FIG. 1.

As can be seen in FIG. 2, the pulses to be counted are provided to the counters (arrow on the far right in the drawing). These successive pulses are counted by a binary register of at least six bits, which they increment. The state of this register can be read at any time (arrow towards the bottom in the drawing). At each incrementation, the register is tested to see whether the number which it contains equals sixty. If this is the case, a pulse is emitted by the test circuit and this pulse causes the register to be reset at zero. The test circuit thus consists of a divider by sixty whose signal can be transmitted to another counter (arrow on the right in the drawing), which is the case of counters 6, 8. Counter 12 may also provide this signal if other counters, of the day or month, are used with it.

Counters 8 and 12 (FIG. 1) define, in usual operation mode, namely in standard time display mode, the position, defined in sixty steps, of the minute and hour hands in relation to the timepiece hour-circle. As the watch described here does not include a second hand, the second hand position counter is used solely to generate a signal whose frequency enables the other counters 8 and 12 to be incremented in an appropriate manner.

The timepiece is also provided with two motors 18 and 20 able to be controlled independently respectively by driving circuits 14 and 16 to drive respectively the minute hand and hour hand. Circuits 14 and 16 receive, in standard time mode, pulses applied respectively to the inputs of the minute hand position counter 8 and the hour hand position counter 12.

The arrangement of the motors and gears of the present timepiece will not be described here. Clockwork movements comprising several motors to activate the hands individually are already known. Patent EP-0 393 606 in particular discloses a clockwork movement comprising two motors capable of independently driving the minute and hour hands.

The watch elements, shown in the block diagram of FIG. 1, which have just been described, explain the essentially analogue operation of this timepiece for the standard time display. However, according to the present invention, the analogue watch described here may also display data relating to the time in 24 time zones, as well as direction data for the geographical marking and distinction of the 24 time zones.

The elements of FIG. 1 which will be described below, enable, on one hand, the display of the 24 time zones to be achieved to indicate said zones geographically, and on the other hand, the time shown by the hands for each time zone to be corrected, when this proves necessary.

As can be seen in FIG. 1, the timepiece comprises electronic control means 22 to enable it to fulfil various hour display functions and a time zone indicating function. Electronic control means 22 comprise inputs MN and H to receive the contents of the minute hand positions counter 8 and hour hand position counter 12, two activation inputs AN, EN and two inputs $D^+$, $D^-$ for the displacement data of the hands respectively forward and backward.

The signals applied to the inputs AN, EN, $D^+$ and $D^-$ are provided by an interpreting circuit 24 for interpreting the position and displacement of the control stem. The operation of the control stem and the interpreting circuit 24 will not be described in detail here because a man skilled in the art will already know devices of this type. Patent EP 0 175 961, in particular, discloses a control stem used with an interpreting circuit which could easily be adapted to be used with the timepiece presently being described.

Electronic control means 22 also include two outputs Mmn and Mh to supply pulses to motors 18 and 20, and a control output C to control the state of two switches 26, 28 placed at the entry to driving circuits 14, 16 and arranged to transmit to them, either the pulses applied to the inputs of the minute hand position counter 8 and the hour hand position counter 12 when the switches are in a first position marked a, or the pulses supplied by electronic control means 22, when the switches are in a second position marked b.

Electronic control means 22 may be advantageously produced in the form of an integrated circuit comprising a programmed micro-controller. A man skilled in the art will know, from the information provided here, how to carry out the programming of the micro-controller, to enable it to execute the functions described here.

In standard time display mode, the electronic control means are inactive and motors 18 and 20 receive the pulses applied to the respective inputs of the minute and hour hand position counters 8 and 12.

Figure 4:
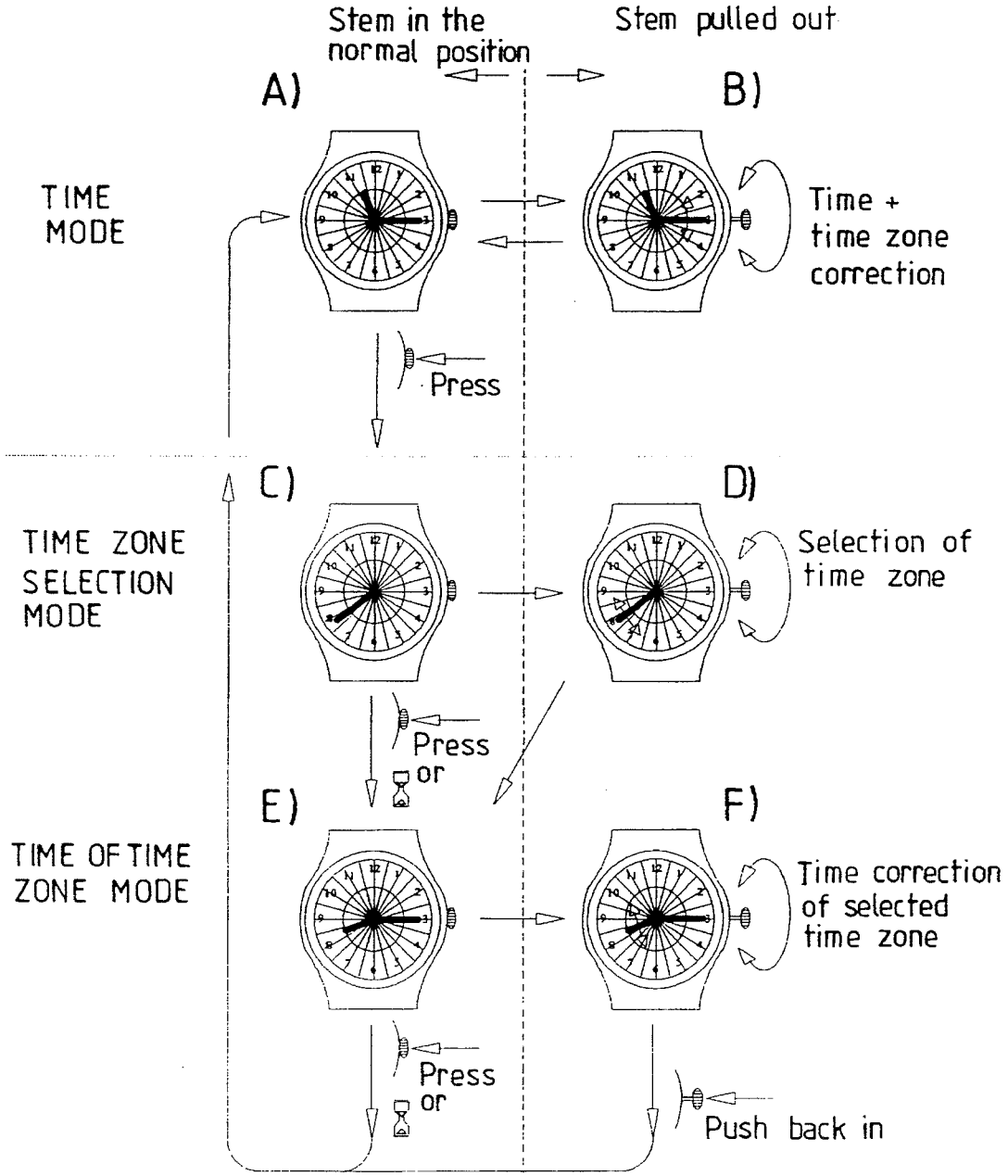
FIG. 4 is a table or operating chart of the different display functions fulfilled by the timepiece according to the invention which comprises a dial such as that shown in FIG. 3.

The table or flow chart in FIG. 4 comprises 6 drawings or steps (marked from A to F) each showing one of the different display functions able to be fulfilled by the watch hands according to the invention. The arrows which link the different steps A to F and the few accompanying pieces of information enable understanding of how the control stem is activated to select one of the different display functions, in the different operation modes described.

Time Setting

The elements described above enable the time displayed by the hands to be corrected (which corresponds to step B in the table in FIG. 4).

When the watch is in the standard time display mode, which is in fact the time of the time zone in which the user is situated (illustrated by step A) , the time correcting function is activated by pulling on the stem. The displacement of the stem outwards causes the interpreting circuit 24 (FIG. 1) to emit a signal to input EN of electronic control means 22. Reception of this signal by electronic control means 22 drives switches 26 and 28 into position b. Simultaneously electronic control means 22 emits a high signal on the reset line of second position counter 6 to keep it at zero so that it does not supply the incrementation signal to respectively minute and hour hand position counters 8 and 12.

Interpreting circuit 24 then sends pulses corresponding to the different rotation movements imparted on the stem, by the user, to inputs $D^+$, $D^-$ of electronic control means 22 which, in turn, emits control pulses to increment or decrement the minute and hour hand position counters 8 and 12 and simultaneously to control motors 18, 20 in order to move the hands. When, after setting the time, the stem is pushed back in, interpreting circuit 24 provides a de-activating signal to electronic means 22 which in turn provides a signal via output C to move switches 26, 28 into position a. Simultaneously, the signal on the reset line returns to zero and second hand position counter 6 restarts.

Time zone display mode

As mentioned above, the timepiece described here is intended to provide time information relating respectively to several time zones.

To this end, this timepiece comprises two counters 27 and 29 (FIG. 1) to store respectively several couples of numerical value HFmn1 to HFmn24, and HFh1 to HFh24 ranging here from 1 to 60, and corresponding respectively to the position of the minute hand and that of the hour hand when they are required to display the time in the different time zones. Counters 27 and 29 are normally incremented by the second time signal, via control means 22.

In FIG. 1 and in the following text, reference will be made to 24 HFmn and HFh numerical values but it goes without saying that a different number of values may be stored in each counter or register 27 if one wishes, in the time zone display mode, to bring the hour and minute hands into a position corresponding to other different times of time zones distributed in another way.

The timepiece according to the invention also comprises two counters or registers 31 and 33 enabling two sets of numerical values PFmn1 to PFmn24 and PFh1 to PFh24 to be stored, also ranging from 1 to 60 and corresponding respectively to the different positions of the two hour and minute hands in their function as indicators of a particular time zone inscribed on the dial.

Here too a different number of indicating positions may be stored.

Figure 3:
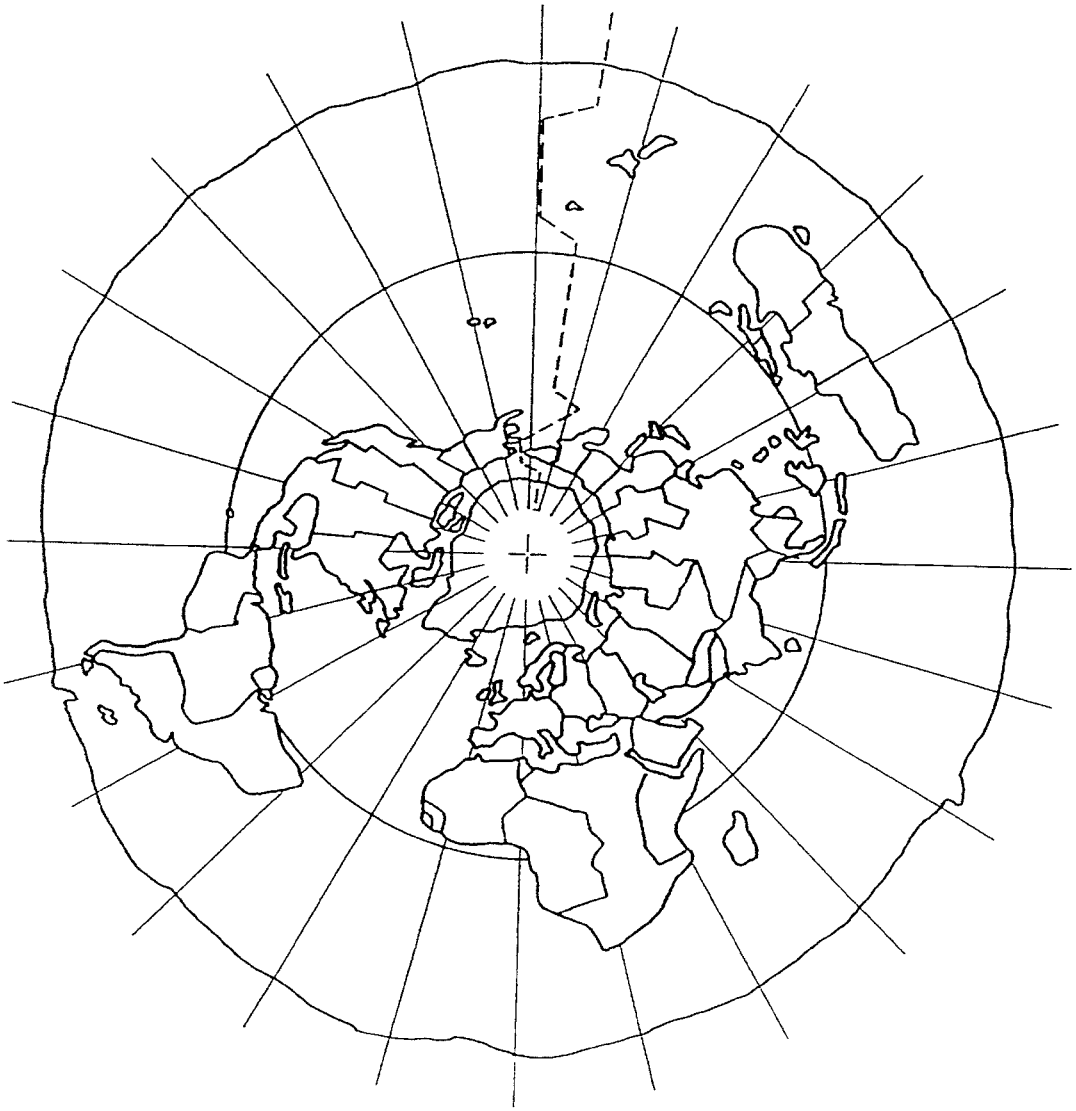
FIG. 3 is an enlarged top view of a dial of the timepiece according to the invention, showing the terrestrial globe seen from the North Pole with the 24 time zones shown on it.

Referring now to FIG. 3, one sees that the dial (not shown) of the timepiece according to the invention comprises an image which is a view of the terrestrial globe, seen from the North Pole, with the time zones inscribed it.

The operation principles of a timepiece comprising means of displaying the time and time zones according to the invention are described below.

The user, when he wishes to consult or set the different times in the different time zones, must effect a certain number of manipulations of the control stem, such manipulations being shown in FIG. 4, to which reference will now be made.

Entry into the universal time display mode

When the watch is in the standard time display mode and interpreting circuit 24 (FIG. 1) emits, in the direction of input AN of electronic control means 22, an activation signal corresponding to a pressure exerted on the stem, electronic control means 22 emits a signal at its output C to put switches 26 and 28 into state b (FIG. 1), that is to say to block the pulses coming from counters 8 and 12. Simultaneously, electronic control means 12 reads the contents of counters 8 and 12 in order to know the position of the minute and hour hands. They then emit the requisite number of pulses to inputs Mmn and Mh to lead the hands to superpose each other in a selected position on the timepiece to enable the time zone corresponding to the current time to be displayed. This step referenced C in FIG. 4, does not affect the operation of counters 6, 8 and 12.

It is understood that before leading the hands to move into this superposed configuration above one of the 24 time zones, electronic control means 22 first of all reads the numerical values PFmni and PFhi of time zone position counters 31 and 33, being values which correspond to the position of the nth (where n is an integer) time zone previously stored in the control means as being the last time zone selected in the past by the user.

Thus in step C, by way of example, if the hands are brought into the superposed indicating position of the time zones close to 8 o'clock, as is the case in FIG. 4, the electronic control means lead the hour and minute hands to superpose each other next to the 8 o'clock sign by emitting a number of pulses equal to the number of pulses which are necessary to make the contents of counters 8 and 12 both equal to around 38, said value 38 being read by the counters in the registers 31 and 33.

Next, in step D, the user can pull out the stem and by a slow rotation in one direction or the other, he can move the hour and minute hands into the superposed position facing one of the other time zones marked on the dial. At this point, electronic means 22 read from counters 31 and 33 as a function of the new numerical value corresponding to the new angular position of the two hands on the piece, which of the 24 existing time zones is the corresponding one, and after identification of the time zone, electronic control means 22 will read in the multiple data counters or registers 27 and 29, which position of the minute and hour hands will enable the time in this time zone to be displayed, and thus which are the corresponding HFmn and HFh values. Then, after the user has returned the stem to its normal position or has applied new pressure to the stem or after a few seconds, the timepiece according to the invention (step E) displays the time in the selected time zone, and thus by providing to motors 18 and 20 the number of pulses necessary to move the hour and minute hands into their new time display position in relation to their former superposed position corresponding to the geographical marking of the selected time zone.

In this position (step F), the user can pull out the stem and modify the time of the time zone being considered, that is to say modify the HFmn, HFh numerical value, of the counters or registers 27 and 29 corresponding to the position of the minute and hour hands for the time of the nth (where n is an integer) time zone being considered or to move from winter to summer time.

After the user has pushed the stem back in, the timepiece returns to standard time mode to display the time in the time zone in which the user is situated. To this end, electronic control means 22 reads registers 8 and 12 and provides the necessary number of pulses to motors 18 and 20 to move the hands into their new display position.

It is thus clear from the above that an analogue display timepiece with a universal time display is provided, in which the analogue organ which enables the time zones to be indicated consists of the two hour and minute hands brought under control by electronic control means 22 in a superposed position one in relation to the other.

It should be noted here that the analogue organ indicating the time zones may be comprised of one of the two time display hands, for example the hour hand, leaving the other hand, notably the minute hand immobile when indicating the corresponding time zone. Thus in this further example, the electronic control means would only use one of the position counters 31 or 33.

It is also clear that electronic control means are provided which comprise means of controlling the angular position of the hand or hands in the geographical indicating function of the location of the time zones, in conjunction with time data dedicated to the different zones and controlled respectively by position counters 27 and 29. Further, this timepiece comprises means of storing the angular position of the hand or hands, namely counters 31 and 33, as a function of geographical indications carried by the piece, namely as a function of the view of the terrestrial globe from the North Pole inscribed on the dial.

Further, the storage means are controlled by the stem and/or by other exterior control organs which may be activated by the user to bring the time hand or hands, here both hands, into a superposed position, in their indicating function facing said geographical indications carried by the piece.

What is claimed is:

1. An analogue display universal timepiece comprising an hour display member, a minute display member, said hour display means and said minute display member forming a time-zone selection member, and means for controlling said hour display, said minute display and said time-zone selection member; said control means being responsive to a manual control signal to drive said selection member so as to select a time zone; wherein said control means superpose said display members in responding to said manual control signal, and wherein said selection member is formed by said superposed display members said control means further being responsive to a time-base signal, and to a signal which is representative of the selected time zone, to drive said minute and said hour display member so that they display time-related information relative to the selected time zone; wherein said control means respond to said manual control signal to drive said selection member to a selected angular position selected from a plurality of twenty-four distinct angular positions, each corresponding to a different time zone.

2. The timepiece according to claim 1, further comprising a stem which is manipulatable by a user to generate said manual control signal.

3. The timepiece according to claim 1, wherein said control means comprise a first motor for driving said hour display member, and a second motor for driving said minute display member.

4. The timepiece according to claim 1, wherein said control means comprise means for storing said selected angular position and generating said signal representative of the selected time zone.

5. The timepiece according to claim 1, wherein said control means comprise means for storing time-related data for each time zone.

6. The timepiece according to claim 1, further comprising a representation of the earth having twenty-four time zones.

7. A timepiece according to claim 6, wherein said timepiece comprises a dial carrying said representation of the earth.

8. The timepiece according to claim 7, wherein said representation of the earth shows the earth from the north pole.

* * * * *